United States Patent [19]

Goda et al.

[11] 4,409,751

[45] Oct. 18, 1983

[54] FIREARM SUPPORT

[76] Inventors: Richard M. Goda; Raymond N. Goda, both of c/o 701 Smithfield St., Pittsburgh, Pa. 15222

[21] Appl. No.: 297,243

[22] Filed: Aug. 28, 1981

Related U.S. Application Data

[63] Continuation of Ser. No. 114,503, Jan. 23, 1980, abandoned, which is a continuation of Ser. No. 9,746, Feb. 5, 1979, abandoned, which is a continuation of Ser. No. 880,711, Feb. 23, 1978, abandoned.

[51] Int. Cl.[3] ..... F41C 29/00
[52] U.S. Cl. ..... 42/94
[58] Field of Search ..... 42/94

[56] References Cited

U.S. PATENT DOCUMENTS

| | | | |
|---|---|---|---|
| 2,870,683 | 1/1959 | Wisson | 42/94 |
| 3,041,938 | 7/1962 | Seabrook | 42/94 |
| 3,608,225 | 9/1971 | Manuel | 42/94 |
| 3,827,172 | 8/1974 | Howe | 42/94 |
| 4,026,057 | 5/1977 | Cady | 42/94 |

*Primary Examiner*—Charles T. Jordan
*Attorney, Agent, or Firm*—Kenneth R. Glaser

[57] ABSTRACT

A firearm support for holding and steadying a small arm such as a rifle is disclosed. The firearm support includes a barrel support for supporting the barrel end of the firearm, a stock support for supporting the stock of the firearm and at least one adjustable slider rod interconnecting the barrel support with the stock support.

3 Claims, 3 Drawing Figures

FIREARM SUPPORT

This is a continuation of application Ser. No. 114,503, filed 1/23/80 which is a continuation of application Ser. No. 9,746, filed Feb. 5, 1979, which is a continuation of application Ser. No. 880,711, filed Feb. 23, 1978, all now abandoned.

This invention relates generally to firearm supports, and even more particularly, to adjustable rifle supports.

In the past, gun owners have used a variety of makeshift gun rests such as rocks, crotches of trees, fence posts, etc. for holding and steadying firearms in order to aim them. The longer the small arms, the more essential it becomes to steady the barrel end of the arms on some fixed support.

Other methods have also been used for supporting firearms such as piling sandbags to support the barrel end of the firearm. Some rifle owners have resorted to the use of tripods for steadying the barrel end of their rifles while aiming at target. A tripod has the advantage of being less cumbersome and, hence, more readily portable than sandbags. In addition, a tripod is more susceptible to precise vertical adjustment.

The use of a tripod for supporting the barrel end of a rifle, however, includes the disadvantage that the rifle cannot simply be rested while the marksman is waiting for an opportune time to take another shot. A rifle support such as the one described in U.S. Pat. No. 2,472,804 issued to Bird can be used to allow a marksman to rest his rifle in a near operational position. The Bird patent teaches the use of a monopod engaging the front trunnion of a rifle and a bipod attached to the rear trunnion for supporting the rifle in a near horizontal rest position. The invention described by Bird particularly has the disadvantage of being semi-permanently attached to a particular rifle. This means that it is necessary to have one device for every rifle which a gun owner might own, or unscrewing and removing the device from one rifle and installing it on another whenever it is desirable to change rifles. The device, being associated with its rifle, also reduces the ease of carrying and sheathing the rifle.

Another approach to supporting a rifle is described in U.S. Pat. No. 3,390,477 issued to Galbraith. The device of the Galbraith patent supports the arm of the marksman rather than supporting the rifle itself. This has the advantage of not being attached to a particular firearm and of being readily removable since it is only held in place by straps. The device does, however, restrict the movement of the user and is of little utility when firing from a prone position.

It is therefore a principal object of the invention to provide a new and improved firearm support. It is another object of the present invention to provide a lightweight, easily portable, support for a firearm.

It is another object of the present invention to provide means to support a firearm in a rest position which is proximate to the firing position.

It is yet a further object of the present invention to provide a support for a firearm which does not substantially hamper the movement of the user.

In accordance with these and other objects, the present invention is directed to a firearm support comprising a barrel support assembly for pivotally supporting the barrel end of the firearm, a stock support assembly for removably supporting the stock of the firearm, and means for adjustably fixing the relative lateral and vertical position of the stock support assembly with respect to the barrel support assembly.

In accordance with a preferred embodiment of the present invention, the barrel support assembly includes a substantially U-shaped riser support for receiving the forward end of the barrel of the firearm and a base portion rigidly affixed to the substantially U-shaped riser support for stabilizing the barrel support assembly. Similarly, the stock support assembly includes a generally U-shaped riser support for receiving the stock of the firearm and a portion rigidly affixed to the substantially U-shaped riser support for stabilizing the stock support assembly. The means for adjustable fixing the lateral position of the stock support with respect to the barrel support includes at least one slider rod interconnecting the barrel support and the stock support assemblies; and means are also provided to respectively vertically level and adjust the assemblies.

Additional features, as well as other objects and advantages, of this invention will be apparent from the following detailed description taken with reference to the accompanying drawings, wherein.

Figure 1:
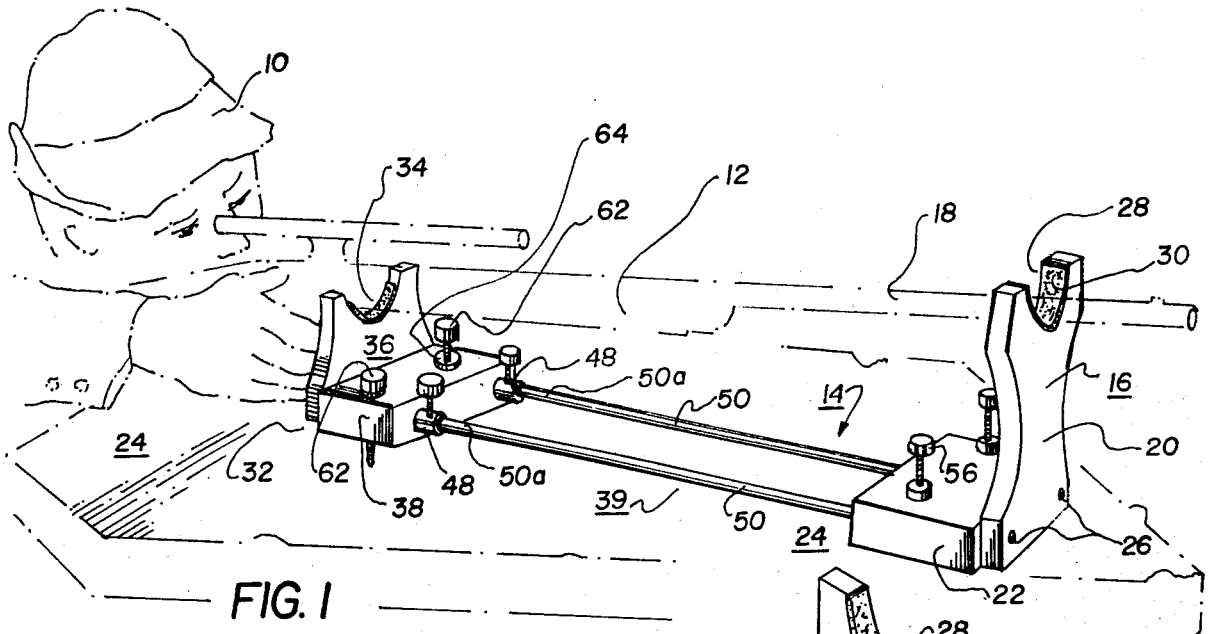
FIG. 1 is a pictorial representation of a marksman aiming a rifle with the aid of the firearm support of this invention.

Referring now to the drawings, and particularly FIG. 1 thereof, a marksman 10 is depicted as aiming a firearm, in this case a rifle 12, utilizing the firearm support 14 constructed in accordance with the present invention. Specifically, the firearm support 14 includes a barrel support assembly 16 for supporting the forward end of barrel 18 of the rifle 12; a stock support assembly 32 by which the rear portion of the rifle is supported; and means 39 for interconnecting, and enabling the lateral adjustment of, the barrel and stock support assemblies.

Barrel support assembly 16 includes a riser portion 20 secured (by screws 26, for example) to block portion 22 which, during use, rests upon a support surface 24. The barrel support riser 20 defines, at the top surface thereof, a generally U-shaped recess 28 adapted to receive and support the end of the barrel 18 of rifle 12, with a pad 30 (of foam material, or the like) lining the recess 28. Thus, the barrel end is supported by, and is capable of pivotal movement within, the cushioned recess 28 of the assembly 16.

Figure 2:
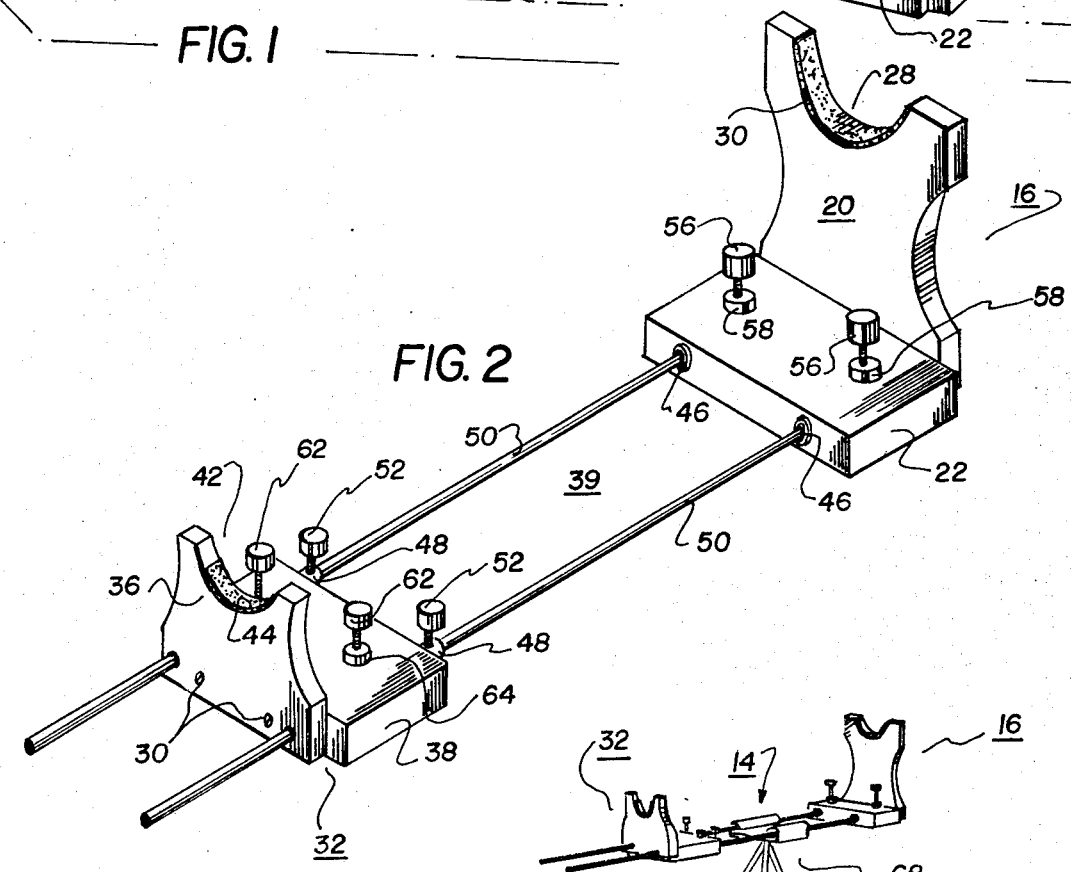
FIG. 2 is a perspective view of a preferred embodiment of the firearm support of this invention.

The stock support assembly 32 removably supports the stock 34 of rifle 12 and also includes a riser portion 36 adapted to cradle the stock of the firearm, with riser 36 secured to a base portion 38 which is also supported, during use, upon the surface 24. The stock support base 38 can be rigidly affixed to the riser 36 by screws 30, for example, as shown in FIG. 2. Similar to the barrel support riser, the stock support riser 36 defines, at its top surface, a generally U-shaped recess 42 in which stock 34 can be supportable received, with a foam cushion pad 44 lines the recess surface, as depicted in FIG. 2. The riser 36 will normally have a lesser height than riser 20 so that the rifle, when supported in assemblies 16 and 32, angles upward.

In accordance with a unique feature of the present invention, the firearm support 14 also includes means 39 for adjustably fixing the lateral position of the stock support assembly 32 with respect to the barrel support assembly 16. Specifically, and in accordance with the preferred embodiment depicted in FIG. 2, the adjustment means 39 comprises a pair of slider rods 50 threadably secured, for example, at their one ends to the barrel support base 22 by way of collars 46. The opposed ends 50*a* of the rods 50 slidably extend through the stock support base 38 (by way of collars 48), the rods 50 thus serving as guides or tracks along which the stock support assembly 32 can be laterally positioned with respect to the forward barrel support assembly 16. A pair of adjustment screws 52 transversely extending through the collars 48 rigidly position the assembly 32 at the desired location along the rods 50.

In accordance with another unique feature of the support 14, the barrel support base 22 (and hence, the entire assembly 16) is adapted for vertical positioning with respect to the support surface 24. Specifically, a pair of spaced leveling screws 56 are adapted to vertically extend (by way of threaded collars 58) entirely through the block 22 so that the tightening of these screws is effective to elevate the block 22 from the support surface 24. It is also apparent that individual adjustment of these screws 56 will be effective to level (or cant) the entire support assembly 16.

Similarly, stock support base 38 includes means associated therewith for balancing or vertically adjusting the stock support assembly 32. In this example, the means for balancing and/or vertically adjusting stock support 32 includes leveling screws 62 which are adapted to threadably extend (by way of collars 64) through base 38. As previously described with respect to support 16, the leveling screws 62 are substantially longer than the vertical dimension of stock support base 38 so that as the leveling screws 52 are tightened, and therefore engage support surface 24, they are effective to raise (or level) stock support assembly 32.

From the foregoing, it can be seen that a firearm support in accordance with this invention is especially well suited for facilitating the steadying and sighting of a rifle from the prone position; and prior to the actual firing of the rifle, it can be supported within the barrel and stock support assemblies. Although a rifle can be fired from this support position, it will normally be desirable to elevate the stock 34 from the stock support assembly 32 which will thus pivot the rifle barrel in the barrel support assembly 16. Therefore, while the marksman is moving the stock end of the rifle in order to take aim, barrel support 16 supports and steadies the forward end of the barrel 18, while allowing it to pivot to the desired angle. Pad 30 which is in direct contact with barrel 18 absorbs any shocks associated with the movement and firing of rifle 12, while pad 44 absorbs any shocks at the rear of the rifle.

The loosening of the adjustment set screws 52 enables the stock support assembly 32 to be laterally positioned along slider rod 50 so that stock support 32 can be moved nearer to and further from barrel support assembly 16, thus accommodating rifles of various lengths. When the stock support 32 is adjusted the desired distance from the forward barrel support 16, the screws 52 can be tightened, thus fixing the position of the stock support with respect to the barrel support. Adjustment of the respective screws 56 and 62 then vertically position the assemblies 16 and 32 with respect to the supporting surface as well as with respect to each other.

The blocks 22 and 38 and risers 20 and 36 can be constructed of any suitable material, such as wood or plastic. Such a firearm support according to this invention is thus lightweight and easily transportable. By loosening tightening screws 52 and sliding stock support assembly 32 off slider rods 50, and then unscrewing slider rods 50 from threaded collars 46, the entire firearm support device can be disassembled for easier transport.

Figure 3:
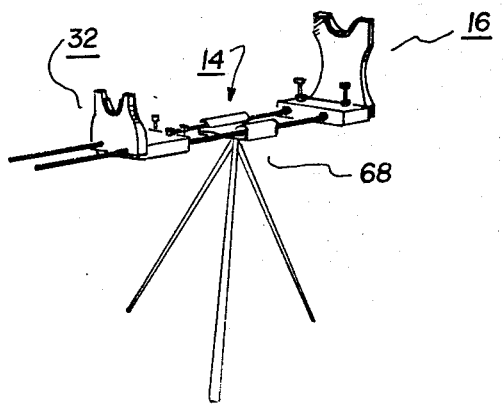
FIG. 3 is a pictorial view of an alternate embodiment and use of the firearm support of this invention.

With reference now to FIG. 3, there is depicted an alternate embodiment and use of the firearm support of the present invention. Specifically, in this embodiment the support 14 is removably coupled with a vertical support which, in this example, is a tripod 68. The inclusion of tripod 68 thus allows a marksman to utilize the firearm support 14 for firing from a standing (or other than a prone) position.

From the foregoing it will be seen that this invention is one well adapted to attain all of the ends and objects hereinabove set forth, together with other advantages which are apparent from, and inherent to, the apparatus.

Various modifications to the disclosed embodiments, as well as alternate embodiments, of the present invention may become apparent to one skilled in the art without departing from the spirit and scope of the invention as defined by the appended claims.

We claim:

1. A firearm support, comprising:

(a) a barrel support assembly comprising (1) a barrel support riser for pivotally supporting the barrel of the firearm, and (2) a barrel support base adapted to be supported by a support surface and rigidly affixed to said barrel support riser for stabilizing said barrel support riser;

(b) a stock support assembly comprising (1) a stock support riser for removably supporting the stock of the firearm, and (2) a stock support base adapted to be supported by a support surface and rigidly affixed to said stock support riser for stabilizing said stock support riser; and (c) adjusting means for adjustably fixing the relative lateral position of said stock support assembly and said barrel support assembly comprising at least one slider rod threadably engaging said barrel support assembly and slidably extending through said stock support assembly.

2. A firearm support according to claim 1, wherein: the barrel support riser comprises a generally U-shaped support for receiving the barrel of the firearm; and a pad lining the top of the U-shaped support whereby the barrel of the firearm is pivotally restable on the pad; and the stock support riser comprises a generally U-shaped support for receiving the stock of the firearm, and a pad lining the top of the U-shaped support whereby the stock is removably restable on the pad.

3. A firearm support according to claim 2, wherein: the barrel support base comprises, in combination, a support block rigidly affixed to the barrel support riser, and a means for balancing and vertically adjusting the barrel support; and the stock support base comprises, in combination, a support block rigidly affixed to the stock support riser, and a means for balancing and vertically adjusting the stock support.

* * * * *